US006752724B1

(12) United States Patent
Schumacher

(10) Patent No.: US 6,752,724 B1
(45) Date of Patent: Jun. 22, 2004

(54) GOLF STANCE GUIDANCE SYSTEM AND METHOD

(76) Inventor: Thomas Schumacher, 833 S. Vine St., Denver, CO (US) 80209

( * ) Notice: Subject to any disclaimer, the term of this patent is extended or adjusted under 35 U.S.C. 154(b) by 0 days.

(21) Appl. No.: 10/217,982

(22) Filed: Aug. 12, 2002

(51) Int. Cl.[7] ..... A63B 53/06; A63B 53/16; A63B 69/36

(52) U.S. Cl. ..... 473/266; 473/270

(58) Field of Search ..... 473/217, 218, 473/257, 266, 270, 271, 452, 440; 273/DIG. 30

(56) References Cited

U.S. PATENT DOCUMENTS

| | | | | | |
|---|---|---|---|---|---|
| 3,604,711 | A | * | 9/1971 | Hansburg | 473/257 |
| 3,920,248 | A | * | 11/1975 | Medders | 473/218 |
| 4,095,797 | A | * | 6/1978 | Breese | 473/257 |
| 4,188,944 | A | * | 2/1980 | Augustyniak | 602/20 |
| 5,482,284 | A | | 1/1996 | Vandever | |
| 5,527,037 | A | | 6/1996 | Matsumoto | |
| 5,529,305 | A | | 6/1996 | Wu | |
| 5,588,653 | A | | 12/1996 | Robinson | |
| 5,611,738 | A | | 3/1997 | Lundquist | |
| 5,616,085 | A | | 4/1997 | LaCoste, Jr. et al. | |
| 5,665,008 | A | | 9/1997 | Chaney | |
| 5,897,442 | A | * | 4/1999 | Honderd | 473/218 |
| 6,171,201 | B1 | | 1/2001 | Tiller | |
| 6,346,050 | B1 | | 2/2002 | Larson | |

* cited by examiner

*Primary Examiner*—Gregory Vidovich
*Assistant Examiner*—Alvin A. Hunter, Jr.
(74) *Attorney, Agent, or Firm*—Ramon L. Pizaaro; Edwin H. Crabtree

(57) ABSTRACT

A golf training apparatus that includes a first elongated flexible strip of a stance length, and a second elongated flexible strip of a ball distance length. According to an example of the invention, the first elongated flexible strip and the second elongated flexible strip include an area of loop-type material, or material that cooperates with hook-type material. The first elongated flexible strip and the second elongated flexible strip may then be joined to one another by providing a separate section of hook-type material or by incorporating hook-type material onto the first elongated flexible strip and the second elongated flexible strip.

11 Claims, 2 Drawing Sheets

GOLF STANCE GUIDANCE SYSTEM AND METHOD

BACKGROUND OF THE INVENTION (a) Field of the Invention

This invention generally relates to a device or system that allows a person to accurately and consistently position their feet, body and arms while swinging a golf club. More particularly, but not by way of limitation, to a system made of interconnectable flexible strips that cooperate with one another and serve to guide the golfer in proper stance and swing of the golf club.

(b) Discussion of Known Art

The game of golf is characterized by the need to develop a consistent, accurate swing of the golf club. In order to develop a good golf swing, an individual must consistently position his feet along a line that is parallel to the desired line of travel of the golf ball. Additionally, the proper body alignment, along with the gripping of the club and the swing of the upper body and the arms must also be mastered. As is well understood by golfing enthusiasts, it is very difficult to bring all of these things together by merely thinking about them before swinging the club. Furthermore, if the player has to think about these factors before swinging the club, chances are that they will distract the player from other aspects, such as hitting the ball.

In order to allow the player to focus on fewer variables, it has been widely accepted that it is important to have some of the variables become second nature or instinctive in the golfer. To do this, the golfer must practice assuming the correct position and movement until they become instinctive, so that he no longer has to think about these variables while executing the swing. There are many devices that are designed to help the golfer practice the different aspects of the golf swing. Examples of these devices can be found in U.S. Pat. No. 6,171,201 to Tiller and U.S. Pat. No. 6,346,050 to Larson, and devices shown in the patents referenced therein. All of these devices provide some sort of guide for the placement of the player's feet as well as a guide for the placement of the ball or line of travel for the golf club.

An important drawback to known systems for aiding golfers with their swings is that they are made from or include rigid components that can be easily used over a flat areas but cannot easily accommodate the contours of the terrain found throughout a golf course. Additionally, most of these devices are not easily collapsed so as to allow a golfer to carry them in his golf bag during play. Still further, devices made with rigid components typically include fixed, pre-set adjustment graduations that may not precisely accommodate the proportions of all players. Additionally, these rigid components can damage club-heads or be broken if they are struck with a club during practice. Still further, these devices serve for helping the golfer with a specific problem, and are not very useful in helping a golfer overcome a variety of problems with his swing.

Therefore, a review of known devices reveals that there remains a need for a simple device that can be used to guide golf players in achieving the proper stance and body position prior to swinging the golf club.

There remains a need for a golfing training device that allows a player to fine-tune or adjust the device to accommodate a wide variety of players.

There remains a need for a golfing training device that can accommodate variations in the underlying terrain to allow the golfer to use the device while playing a round of golf, and thus train the player during actual play.

There remains a need for a golf-training device that is safe for both golfers and their golf clubs. In other words, there remains a need for a device or system that will yield rather than damaging the clubs or injury to the player.

There remains a need for a golfing training device that is useful for aiding golfers in all aspects of golf practice.

SUMMARY

It has been discovered that the problems left unanswered by known art can be solved by providing a golf training apparatus that includes:

A first elongated flexible strip of a stance length; and

A second elongated flexible strip of a ball distance length.

According to an example of the invention, the first elongated flexible strip and the second elongated flexible strip include an area of loop-type material, or material that cooperates with hook-type material which is commonly known under the trademark Velcro. The first elongated flexible strip and the second elongated flexible strip may then be joined to one another by providing a separate section of hook-type material or by incorporating hook-type material onto the first elongated flexible strip and the second elongated flexible strip of course, it is contemplated that other connection devices, such as clamps, snaps, elastic bands, or other devices that can be used to retain the first elongated flexible strip against the second elongated flexible strip.

It is also contemplated that the disclosed system may be used with markers with an adhesive, such as an adhesive that cooperates with hook and loop type material, so that the markers may then be positioned along the first elongated flexible strip and the second elongated flexible strip to guide the user on the locations for foot placement.

Still further, it will be understood that the first elongated flexible strip and the second elongated flexible strip of the disclosed invention may be filled with a relatively heavy substance that allows each of the strips to flex and conform with the terrain below the strip. Examples of these materials include gel, sand, rubber or cork gasket material, glass beads, water, and others.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
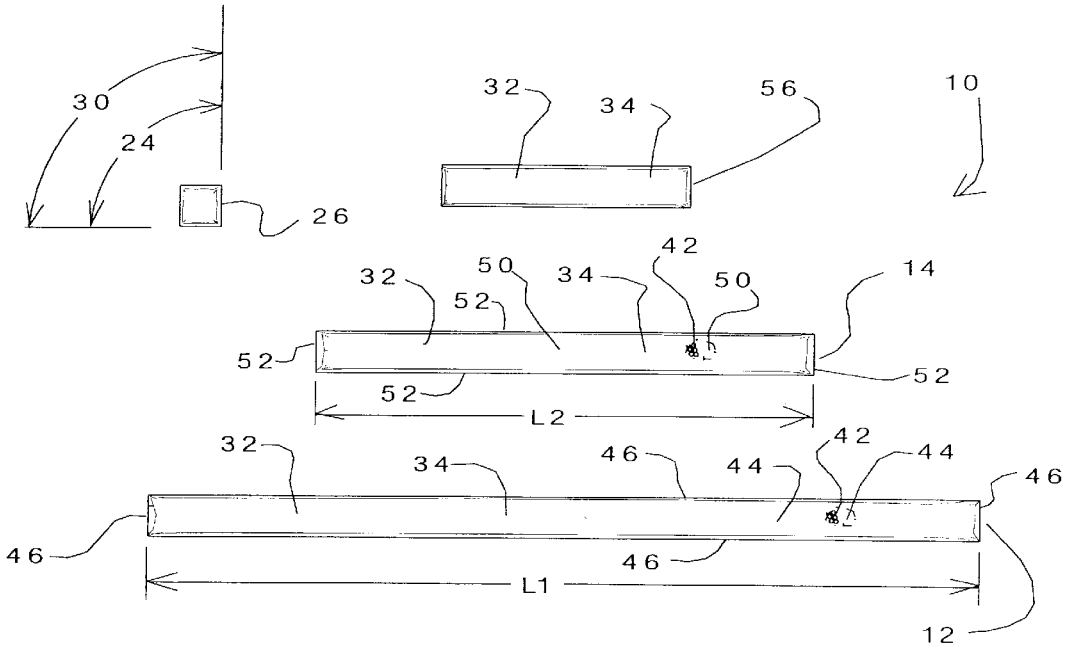
FIG. 1 illustrates components used with the disclosed invention.
Figure 5:
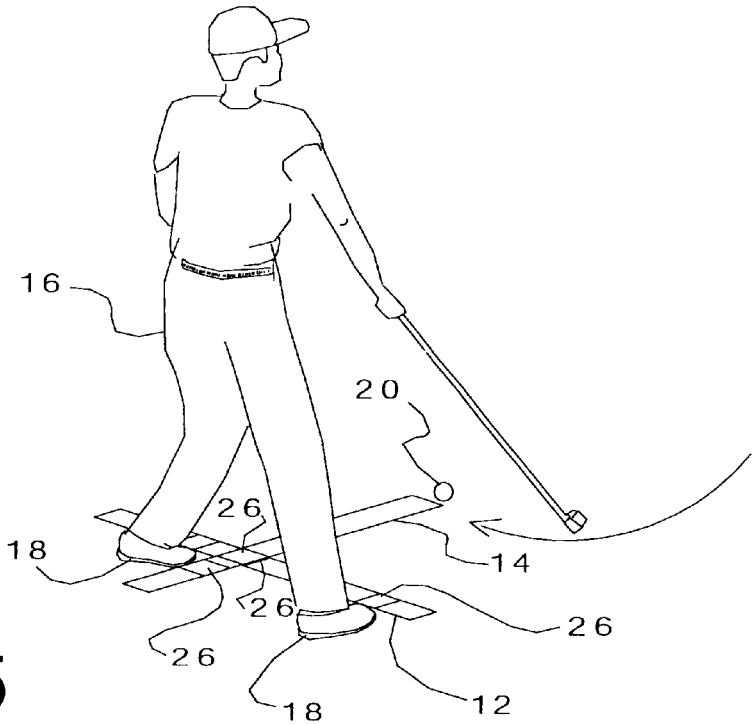
FIG. 5 illustrates the use of the elongated flexible strips in positioning the player's feet.
Figure 6:
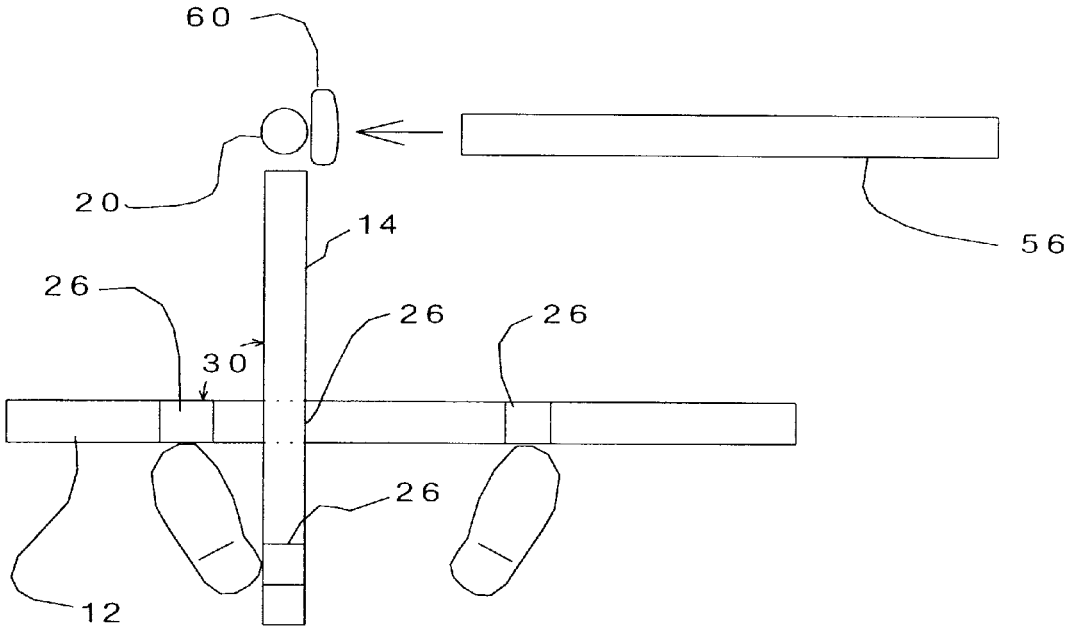
FIG. 6 illustrates the cooperation of the elongated flexible strips in positioning the player's feet.

Turning now to FIG. 1 where components used with the golf swing guidance system 10 have been illustrated, it will be understood that it is contemplated that the disclosed system 10 includes a first elongated flexible strip 12 of a stance length L1 and second elongated flexible strip 14 of a ball distance length L2. As illustrated in FIGS. 5 and 6, it is contemplated that the first elongated flexible strip 12 and the second elongated flexible strip 14 will be used together to guide the person 16 or player in the proper placement of the person's feet 18 in relation to the golf ball 20 that is to be struck by the player.

In order to provide guidance as to the proper distance between the user's feet 18, the stance length L1 should be long enough to allow the user to position his feet at the appropriate location along a straight line. Additionally, the second elongated flexible strip 14 will be of a length that extends to the location from the first elongated flexible strip where the ball is to be placed in order to properly place the ball 20, depending on the golf club to be used by that person.

It is important to note that the proper distance between the player's fee and ball placement for that particular player depends on the club being used and the physical characteristics of that particular player. For example, a tall player will have his feet separated by a longer distance than a shorter player. Also a player using a wood will place the ball closer to his feet than if using an iron to strike the ball. Thus, the disclosed system will allow the user to establish the appropriate foot placement, depending on the person's physical characteristics and the particular club being used.

The disclosed system allows a user to maintain a precise memory or record of the precise location for proper foot placement. In other words, the disclosed system allows infinite adjustment of the feet, rather than requiring the use of pre-determined graduations along a device. Thus, the disclosed system uses hook-and-loop type material over the majority of the stance length L1 of the first elongated flexible strip 12. It is important to note that the term "hoop-and-loop" as used here may refer to the loop type material or the hook type material found in material sold under the trademark Velcro. Thus, the sold under the trademark Touch-Tape. Thus, the surfaces 22 of the first elongated flexible strip 12 or the second elongated flexible strip 14 may be of felt, such as green felt that mimics grass, or any other pile type material that cooperates with the hook type material of the hook-and-loop type material. Accordingly, it is contemplated that the second elongated flexible strip 14 will have hook-and-loop type material over the surfaces 22 for the majority of the ball distance length L2. Thus, the first elongated flexible strip 12 may attach directly to the second elongated flexible strip 14 by incorporating mating hook-and-loop material onto the surfaces 22 of either the first elongated flexible strip 12 or the second elongated flexible strip 14. It is preferred that the two strips attach to one another at an angle 24.

In order to mark the precise location for the player's feet, at least one marker 26 that cooperates with the hook-and-loop material on the first elongated flexible strip 12 or the second elongated flexible strip 14. Once the first elongated flexible strip 12 and the second elongated flexible strip 14 have been attached to one another at an angle 26, the marker 26 is then positioned along the first elongated flexible strip 12 to mark the position of the player's foot. Thus, in order to cooperate with the first elongated flexible strip 12, it is contemplated that the marker 26 will include hook type material 32 on its exterior surfaces 34.

It is also important to note that while it is contemplated that the first elongated flexible strip 12 may attach directly to the second elongated flexible strip 14, the marker 26 may be used to attach the first elongated flexible strip 12 to the second elongated flexible strip 14 at the angle 26. Furthermore, by incorporating right angles 36 into the edges 38 of the marker 26, the edges 38 of the marker 26 may also cooperate with the edges 40 of the first elongated flexible strip 12 or the second elongated flexible strip 14 to guide the placement of the strips to ensure that the first elongated flexible strip 12 and the second elongated flexible strip 14 are positioned at the correct angle 26 to one another, which in the illustrated example is 90 degrees.

Additionally, it is contemplated that the system 10 may include several markers 26, each of a distinctive color to provide the user with the ability to assign a color to a particular club, for example. This would allow the player to carry the first elongated flexible strip 12 in his bag with the different markers 26 attached, allowing the player to quickly draw the first elongated flexible strip 12 from his bag, and then use the markers to place the second elongated flexible strip 14 at an angle 26 against the first elongated flexible strip 12 to provide proper ball location for the user. The order of the placement of the strips may be altered in order to avoid disturbing the ball, but it will be understood that the flexibility of the strips will allow the strips to conform to the terrain of the golf course and allow the strips to be used to practice shots anywhere on the golf course or practice area. Of course, the markers may be color coded or marked to allow the user to remember which marker corresponds with what golf club. This color coding and marking can be carried out on the second elongated flexible strip 14 of a ball distance length L2 in order to facilitate the connection of the first elongated flexible strip 12 to the second elongated flexible strip 14 and achieving the correct ball placement distance for the club being used.

Figure 2:
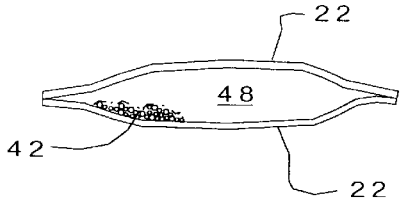
FIG. 2 is a cross-section, taken from FIG. 1, of components used with the disclosed invention.
Figure 3:
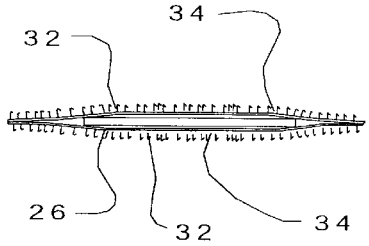
FIG. 3 is a cross-section, taken from FIG. 1, of components used with the disclosed invention.
Figure 4:
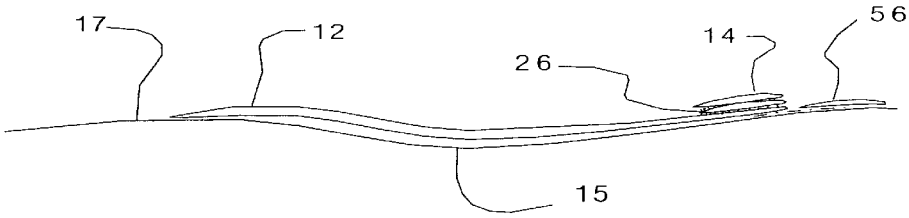
FIG. 4 illustrates the operation of the elongated flexible strips in accommodating the contours of the golf course terrain.

As illustrated in FIG. 2, it is contemplated that the first elongated flexible strip 12 as well as the second elongated flexible strip 14 will be filled with a high-specific gravity, flexible or flowable material 42, such as sand, water, gel, or neoprene rubber, so that the weight and flexibility of the filling material will allow the flexible strip, meaning the first elongated flexible strip 12 or the second elongated flexible strip 14, to conform to any unevenness 15 over the ground 17.

Thus, as illustrated in FIGS. 1 and 2, it is contemplated that the first elongated flexible strip 12 will be constructed from a first pair of panels 44 each of the panels having a perimeter 46, the first pair of panels 44 being connected to one another along the perimeter to form a first pocket 48, which is then filled with the high-specific gravity, flexible or flowable material 42. It is contemplated that the second elongated flexible strip 14 will be constructed from a second pair of panels 50 each of the panels having a perimeter 52, the second pair of panels 50 being connected to one another along the perimeter 52 to form a second pocket 54, which is then filled with the high-specific gravity, flexible or flowable material 42. The high-specific gravity, flexible or flowable material 42 may be held within the pockets by a bladder or other retension mechanism means.

Turning once again to FIGS. 1, 5, and 6, it will be understood that the system 10 may also incorporate at least one swing alignment strip 56, which is used to help the player align the trajectory of the club head 60 during the swing to ensure that the ball will be driven in the desired direction. It is contemplated that the construction of the swing alignment strip 56 will be similar to the construction of the first elongated flexible strip 12 or the second elongated flexible strip 14.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A training system for aiding a person having feet in positioning the feet of the person and positioning a golf ball to be struck by the person over an area of ground that may be uneven, the ball being positioned at a distance from the person, the system comprising:

a first elongated flexible strip of a stance length, wherein the first elongated flexible strip of a stance length comprises a first pair of panels, each of the panels having a perimeter, the first pair of panels being connected to one another along the perimeter to form a first pocket;

a second elongated flexible strip of a ball distance length, wherein the second elongated flexible strip of a ball distance length comprises a second pair of panels, each of the panels having a perimeter, the second pair of panels being connected to one another along the perimeter to form a second pocket;

a connector that selectively attaches the first elongated flexible strip to the second elongated flexible strip at an angle to the first elongated flexible strip; and at least one foot positioning marker that is selectively positionable on the first elongated flexible strip, so that attachment of the first flexible strip to the second flexible strip at an angle allows the marker to be positioned along the first elongated flexible strip to indicate the position of one of the feet of the person.

2. A system according to claim 1 wherein the first elongated flexible strip of a stance length is filled with a neoprene rubber so that the flexible strip conforms to unevenness over the ground.

3. A system according to claim 1 wherein the first elongated flexible strip of a stance length is filled with granular material so that the flexible strip conforms to unevenness over the ground.

4. A system according to claim 1 wherein the first pocket and the second pocket are filled with a high-specific gravity, flexible material.

5. A system according to claim 1 wherein the first pocket and the second pocket are filled with sand.

6. A system according to claim 1 wherein the first pocket and the second pocket are filled with sand gel.

7. A training system for aiding a person having feet in positioning the feet of the person to create a stance and positioning a golf ball to be struck by the person over an area of ground that may be uneven, the system comprising:

a first elongated flexible strip of a stance length having hook-and-loop type material for majority of the stance length, wherein the first elongated flexible strip of a stance length comprises a first pair of panels, each of the panels having a perimeter, the first pair of panels being connected to one another along the perimeter to form a first pocket;

a second elongated flexible strip of a ball distance length having hook-and-loop type material for majority of the ball distance length, wherein the second elongated flexible strip of a ball distance length comprises a second pair of panels, each of the panels having a perimeter, the second pair of panels being connected to one another along the perimeter to form a second pocket;

and at least one foot positioning marker that is selectively positionable on the first elongated flexible strip, so that attachment of the first flexible strip to the second flexible strip at an angle allows the marker to be positioned along the first elongated flexible strip to indicate the position of one of the feet of the person and the ball next to the second elongated flexible strip.

8. A System according to claim 6 wherein the first elongated flexible strip of a stance length is filled with sand so that the flexible strip conforms to unevenness over the ground.

9. A system according to claim 7 wherein the first pocket and the second pocket are filled with a high-specific gravity, flexible material.

10. A system according to claim 7 wherein the first pocket and the second pocket are filled with sand.

11. A method for training a person having feet in positioning the feet and a golf ball to be struck by the person over an area of uneven ground, the method comprising:

providing a first elongated flexible strip of a stance length, wherein the first elongated flexible strip of a stance length comprises a first pair of panels, each of the panels having a perimeter, the first pair of panels being connected to one another along the perimeter to form a first pocket;

providing a second elongated flexible strip of a ball distance length, wherein the second elongated flexible strip of a ball distance length comprises a second pair of panels, each of the panels having a perimeter, the second pair of panels being connected to one another along the perimeter to form a second pocket;

providing at least one marker that is selectively positionable on the first elongated flexible strip;

placing the first flexible strip across the second flexible strip at an angle;

marking a desired position for each of the person's feet along the first flexible strip with the at least one marker;

placing the feet next to the first flexible strip next to the at least one marker on the first flexible strip and placing the ball next to the second flexible strip and aligned with the second flexible strip.

* * * * *